US009173466B2

(12) United States Patent
Rivola et al.

(10) Patent No.: US 9,173,466 B2
(45) Date of Patent: Nov. 3, 2015

(54) MULTI-FUNCTIONAL DEVICE FOR STYLING HAIR

(71) Applicant: TENACTA GROUP S.p.A., Azzano San Paolo (IT)

(72) Inventors: Marco Rivola, Cenate Sopra (IT); Raffaella Rubini, Mozzo (IT)

(73) Assignee: TENACTA GROUP S.p.A., Azzano San Paolo (IT)

( * ) Notice: Subject to any disclaimer, the term of this patent is extended or adjusted under 35 U.S.C. 154(b) by 0 days.

(21) Appl. No.: 14/159,592

(22) Filed: Jan. 21, 2014

(65) Prior Publication Data

US 2014/0202488 A1 Jul. 24, 2014

(30) Foreign Application Priority Data

Jan. 21, 2013 (IT) ..... MI2013A0074

(51) Int. Cl.

| | |
|---|---|
| ***A45D 1/04*** | (2006.01) |
| ***A45D 2/40*** | (2006.01) |
| ***A45D 2/36*** | (2006.01) |
| ***A45D 1/08*** | (2006.01) |
| ***A45D 2/00*** | (2006.01) |

(52) U.S. Cl.

CPC *A45D 2/367* (2013.01); *A45D 1/04* (2013.01); *A45D 1/08* (2013.01); *A45D 2/001* (2013.01); *A45D 2/362* (2013.01)

(58) Field of Classification Search

CPC ..... A45D 1/04; A45D 1/08; A45D 1/06; A45D 1/14; A45D 2/367; A45D 2/001

USPC ..... 132/224, 225, 229, 237, 238, 231; 219/225

See application file for complete search history.

(56) References Cited

U.S. PATENT DOCUMENTS

| | | | | |
|---|---|---|---|---|
| 6,278,086 | B1 * | 8/2001 | Janouch et al. | 219/222 |
| 7,445,012 | B2 * | 11/2008 | Mukai | 132/224 |
| 2005/0081876 | A1 * | 4/2005 | Choi | 132/224 |
| 2005/0172980 | A1 * | 8/2005 | Julemont | 132/231 |
| 2010/0242985 | A1 * | 9/2010 | Kaizuka | 132/224 |
| 2011/0174331 | A1 * | 7/2011 | Kim | 132/229 |
| 2012/0024311 | A1 * | 2/2012 | Linglin et al. | 132/232 |

* cited by examiner

*Primary Examiner* — Robyn Doan

(74) *Attorney, Agent, or Firm* — Husch Blackwell LLP

(57) ABSTRACT

The invention refers to a multi-functional device (101) for styling hair comprising a handgrip (102), a first and a second arm (104, 105), and means (124, 125) for heating the first and/or the second arm (104,105). The first arm (104) comprises a first fixed half-arm (114) integral with the handgrip (102) and extending substantially along the longitudinal axis (X) and a first mobile half-arm (116) elastically supported by the first fixed half-arm (114) and extending substantially along the longitudinal axis (X) between a first area of the arm (104) close to the handgrip (102) and a second area of the arm (104) remote from the handgrip (102). The device (101) further comprises locking/unlocking means (160) suitable for cooperating with the first mobile half-arm (116) to make the first mobile half-arm to selectively take up one from an unlocked condition, in which the elastic movement of the first mobile half-arm (116) with respect to the first fixed half-arm (114) is allowed, and a locked condition, in which the elastic movement of the first mobile half-arm (116) with respect to the first fixed half-arm (114) at least at the first area of the first atm (104) is prevented.

12 Claims, 9 Drawing Sheets

MULTI-FUNCTIONAL DEVICE FOR STYLING HAIR

CROSS-REFERENCE TO RELATED APPLICATIONS

This application claims the Convention priority date of Jan. 21, 2013, based on Italian Patent Application No. MI2013A000074, entitled MULTI-FUNCTIONAL DEVICE FOR STYLING HAIR. The disclosure of Italian Application No. MI2013A000074 is incorporated herein by reference.

BACKGROUND OF THE DISCLOSURE

1. Field of Disclosure

The present invention refers, in general, to a multi-functional device for styling hair, in particular to an electric device for curling or straightening hair.

2. Background Art

As it is known, electric devices for styling hair are widely used both at home and in professional salons. Among such a variety of devices, there are the categories of devices for curling hair and that of devices for straightening hair.

With particular reference to devices for curling hair, the conventional method of curling a lock of hair consists of winding the hair on a heatable cylinder, letting the lock rest for some minutes and then unwinding it. The lock of hair thus takes up a curled shape, determined by the winding on the heated cylinder during the resting time.

In order to achieve a process of this type, it is known to use a so called curling iron, which is typically provided with a cylinder that can be heated on all its surfaces and a clamp that is connected to a lever that is suitable for being actuated by the user of the device. By exerting pressure on the lever, the clamp opens up, promoting the insertion of a lock of hair between the cylinder and the clamp; by releasing the lever, the clamp returns in contact with the cylinder, locking the lock of hair inside it. Once the lock of hair is locked between the clamp and the cylinder, the user rotates the device, manually or through a motor, so as to curl the remaining part of such a lock of hair around the cylinder. Consequently, the entire length of the lock is wound on the heated cylinder and stays resting on it for a period of time that is sufficient for the hair to take up the required style. At the end of such an operation, the user can release the hair unwinding it and again pressing the lever so as to open the clamp.

Electric curling irons are also known that are equipped with so called "floating" arms. A curling iron of this type is described, for example, in Italian patent application MI2009A001946 to the same Applicant as the present application.

Such electric curling irons with floating arms comprise a handgrip, a first atm and a second arm side-by-side and parallel with respect to one another, associated with the handgrip at, respectively, a first end thereof and heating means arranged at at least one arm. One or both of the arms comprise a fixed half-arm that is integral with the handgrip and a mobile half-arm that is elastically supported by the fixed half-arm. When inserting a lock of hair between the two arms, these are capable of moving away from one another so that the lock is easily positioned inside and are moreover capable of exerting, on the lock itself, a weak pressure so as to hold it automatically inside, i.e. without using any mechanical device like levers or clamps, etc. At this point the lock can be partially wound around the cylinder and with a sliding movement towards the free end of the lock it is possible to obtain the desired curling effect in a very simple and effective manner. The elastic action of the mobile half-arms makes up for the lack of the classic mechanical devices such as levers or clamps, automatically modulating the holding force of the lock as a function of its thickness, at the same time keeping it free just enough so as to be able to slide between the mobile half-arms during the movement for obtaining the curl.

The electric curling irons with floating arms described briefly above have undeniable advantages in terms of manageability that is considerably improved and in terms of a substantial reduction of the working time thanks to the total absence of mechanical elements, like for example, clamps or blades and levers or buttons, which can be an obstacle to the hair curling operations. Considering the particular construction of the arms (two semi-circumferences that face one another) it is possible to think that the same tool can be used not only for curling hair but also for straightening it, since there is indeed the opportunity of being able to insert the lock between two opposite flat surfaces. However, the tool is almost useless for this function without suitable provisions, which is an object of the present invention being made.

Indeed, in the case in which the user desires to use a device with floating plates for straightening her hair instead of curling it, the floating of the plates would not make it possible to exert, on the lock inserted between them, the compression force necessary for straightening it, since the existing compression force offers a resistance that is only suitable for weakly holding the lock so as to be able to make the curl as described above. On the other hand, if such a compression force were increased by acting on the elastic elements interposed between the fixed half-arm and the mobile half-arm, there would be the double problem of having a more difficult insertion of the lock between the two arms and very poor sliding while making the curl, with a consequent poor result. Consequently, in order to straighten hair, it is necessary to make some suitable modifications, since only with a suitable compression force it is possible to obtain the desired straight result. Again, if in the attempt of straightening her hair the user were to exert for example pressure on one end of, the arms that is distal with respect to the handgrip of the curling iron device, this would lead to an undesired lever effect, with the result of a spreading apart of the mobile half-arms at the proximal end of the handgrip, with consequent substantial impossibility of exerting any form of pressure suitable for straightening the lock.

The Applicant has thus tackled the technical problem of providing a multi-functional device for styling hair or rather a device that is capable of curling and straightening hair according to the particular requirement of the user and that at the same time is handy and easy to use.

BRIEF SUMMARY OF DISCLOSURE

The present invention therefore concerns a multi-functional device according to claim 1; optional preferred characteristics are shown in the dependent claims.

In particular, the invention concerns a multi-functional device for styling hair comprising a handgrip, a first and a second arm and heating means suitable for heating at least one of said first and second atm, wherein:—said first and second arm are arranged side-by-side and parallel to one another and extending substantially along a longitudinal axis, associated with said handgrip at a first end thereof, respectively; and—said first arm comprises a first fixed half-arm integral with the handgrip and extending substantially along the longitudinal axis and a first mobile half-arm elastically supported by said first fixed half-arm and extending substantially along the longitudinal axis between a first area of said first arm close to the handgrip and a second area of said first arm remote from the handgrip.

The device is characterised in that it moreover comprises locking/unlocking means suitable for cooperating with the first mobile half-arm to make the first mobile half-arm to selectively take up one from an unlocked condition, in which the elastic movement of the first mobile half-arm with respect to the first fixed half-arm is allowed, and a locked condition, in which the elastic movement of the first mobile half-arm with respect to the first fixed half-arm is prevented at least at said first area of the first arm.

Thanks to the presence of the locking/unlocking means, the device according to the invention can carry out the functions of both curling hair and straightening hair, according to the specific requirements of the user. Indeed, in the locked condition, the first mobile half-arm is kept in contact with the second arm for example in said first area allowing it to spread open in said second area for introducing the lock, so as to keep almost unaltered the easy insertion thereof between the aforementioned first mobile half-arm and the second arm. Once the insertion has occurred, the pressure of the cold tips positioned in said second area with the aid of fingers, makes it possible to dose the straightening pressure on the lock thus obtaining the desired effect very well.

Moreover, thanks to the means for locking the mobile half-arms, it is possible to avoid the undesired lever effect described above with reference to known devices for styling hair.

In one alternative scenario it is moreover possible for the locking/unlocking means to act not only at said first area of the first arm, but to involve its entire extension. Consequently, in order to carry out the straightening, the user inserts the lock in the unlocked condition exploiting the elastic movement of the mobile half-arm and then acts on the locking means.

For the purposes of the present description and of the following claims, by the expression "substantially along an axis" we mean both exactly along that axis, and along an axis the direction of which is slightly moved away from it. Moreover, by the expression "substantially flat", "substantially semi-cylindrical" and "substantially cylindrical" we mean flat, semi-cylindrical and cylindrical shapes, respectively, as well as shapes that are not visibly different, also with reference to elements that take up such shapes for the almost entirety of the dimension of the element itself. Finally, by the expression "arms substantially brought together" we mean arms that are against one another, and arms that are positioned at a very small distance from one another.

According to an alternative embodiment, the second arm comprises a second fixed half-arm integral with the handgrip and extending substantially along the longitudinal axis and a second mobile half-arm elastically supported by said second fixed half-arm and extending substantially along the longitudinal axis between a first area of said second arm close to the handgrip and a second area of said second arm remote from the handgrip; and the locking/unlocking means are suitable for cooperating with the second mobile half-arm to make the second mobile half-arm to selectively take up one from an unlocked condition, in which the elastic movement of the second mobile half-arm with respect to the second fixed half-arm is allowed, and a locked condition, in which the elastic movement of the second mobile half-arm with respect to the second fixed half-arm is prevented at least at said first area of the second arm.

In such a way, in the case in which it is desired to use the device as a device for curling hair or rather with the locking/unlocking means that are disengaged, both the mobile half-arms are capable of moving with respect to the corresponding fixed half-arm and consequently, when inserting a lock of hair between said mobile half-arms, the space between them can adapt in the best and homogeneous manner with respect to the engaged lock, ensuring the suitable sliding for making the curl. On the other hand, in the case in which it is desired to use the device as a device for straightening hair, or rather with the locking/unlocking means inserted, both the mobile half-arms are locked with respect to the corresponding fixed half-arms at for example the respective first area close to the handgrip, and it is hence possible to exert the desired pressure on the cold tips at the second area consequently obtaining the desired straightening.

In another hypothesis, the locking/unlocking means act not only at said first area of the arms, but they involve the entire extension thereof. The lock is thus inserted in the unlocked condition by exploiting the elastic movement of the mobile half-arm and is consequently straightened by means of the action on the locking means.

Said locking/unlocking means can be of any type, for example magnetic, electromagnetic, pneumatic, pressure, electromechanical or mechanical in general, without precluding other systems/methods that are suitable for the purpose.

Preferably, the locking/unlocking means comprise a mechanical member suitable for being actuated through sliding, rotation or pressure to make the first mobile half-arm and/or the second mobile half-arm to selectively take up one from said unlocked and locked conditions. In this way it is possible to obtain a structure that is constructively simple and functionally effective.

Preferably, said mechanical member of the locking/unlocking means is associated with the handgrip of the device. Advantageously, this makes it possible to easily actuate the locking/unlocking means, with the same hand that is holding the device.

Preferably, the mechanical actuation member is a slider and the locking/unlocking means comprise a first tang integral with the first mobile half-arm at for example the first area, said slider being slidable so as to engage and disengage said first tang.

According to an alternative embodiment, the mechanical actuation member is a slider and the locking/unlocking means comprise a first tang integral with the first mobile half-arm at for example said first area and a second tang that is integral with said second mobile half-arm at for example said first area, said slider being slidable so as to engage and disengage said first and second tang.

Preferably, the slider is housed in a seat that is integral with the device and that can be obtained by means of a suitable shape of the components of the device itself. Such a seat, together with the shape of the slider, advantageously acts as a support and guide for the slider, defining and delimiting its most suitable stroke in the desired direction and at the same time preventing, in the locking condition of the device, movements of the first and/or second mobile half-arm in the direction of the respective fixed half-arm at least at the first area close to the handgrip. This ensures the necessary physical abutment so as to indeed prevent, again in the locking condition, the spreading apart of the aforementioned mobile half-arms at least at said first area.

Preferably, the guiding seat of the slider is associated with the handgrip of the multi-functional device and it is obtained through suitable shaping of its constituent elements.

In preferred embodiments, the slider comprises spaced portions and close portion that are suitable for engaging and disengaging the first tang and/or the second tang, the slider being able to slide in a transversal direction to the longitudinal axis.

Preferably, in the locking condition of the elastic movement of the first and/or the second mobile half-arm with respect to the first and/or second fixed half-arm, the first tang and/or the second tang abut against the close portions of the slider at least at the first area of the first and/or the second arm, whereas in the unlocked condition of the elastic movement of the first and/or the second mobile half-arm with respect to the first and/or second fixed half-arm the first and/or the second tang are mobile between the spaced portions.

In one particularly preferred embodiment, the slider comprises first and second spaced portions and first and second close portions that alternate with one another, inclined joining portions, between the first spaced portions and the first close portions and between the second spaced portions and the second close portions, respectively, and it comprises connection portions between the first spaced portions and the second close portions, respectively.

Preferably, the first tang and/or the second tang comprises a flat face and two engagement tabs extending from the respective flat face in a direction that is substantially perpendicular to it, said engagement tabs being suitable for abutting against said first and second close portions of the slider in the locking condition of the elastic movement of the first mobile half-arm with respect to the first fixed half-arm at at least the first area of the first and/or the second arm.

In one alternative embodiment, the slider comprises an actuation portion and a pair of close and parallel arms suitable for engaging and disengaging the first tang and/or the second tang, the slider being slidable in a direction parallel to the longitudinal axis.

Preferably, the actuation portion is made from a rigid plastic material and comprises a free end suitable for projecting from an opening formed in the handgrip of the device and the pair of arms can be made from flexible plastic material, so that the slider during actuation becomes elastically deformed so as to bring the device from the locking condition to the unlocked condition, or vice versa. In particular, in the locking condition the first tang and/or the second tang are clamped into contact between the pair of close and parallel arms at at least the first area of the first and/or the second arm.

In a preferred embodiment, the mechanical actuation member is a ring nut and the locking/unlocking means comprise a first tang integral with the first mobile half-arm at for example the first area and/or a second tang integral with the second mobile half-arm at for example the first area, the ring nut being rotatable about the longitudinal axis so as to engage and disengage the first tang and/or the second tang.

Preferably, the ring nut is provided with an opening or with a shaped protuberance in which the first tang and/or the second tang engage and disengage.

Preferably the opening or the shaped protuberance formed in the ring nut is slot-shaped with two parallel sides that are close to one another and two end sides that are more distant from one another. The orientation of the ring nut (and therefore of the slot) determines the locking/unlocking condition of the mobile half-arms with respect to the respective fixed half-arm. In particular, in the locking condition, the first tang and/or the second tang abut against the narrower walls of the slot shape, at at least the first area of the first and/or of the second arm.

For this and for the previous embodiments the shape of the tang or of the tangs can be conceived both plate-like and with a different shape (for example semicircular) for a better operation of the locking/unlocking mechanism and better compatibility with the selected embodiment.

Preferably, each of said first and second arm has an overall substantially semi-cylindrical shape, with a first flat face that is formed on said mobile half-arm and a second convex shape that is formed on said fixed half-arm, said flat faces facing one another, said convex faces facing opposite one another.

In such a way there is the advantage of said first and second arm together forming a substantially cylindrical element, which is the most suitable shape for an element around which a lock of hair is to be wound for making the curl.

Preferably, the locking/unlocking means also comprise a spacer element, such as a plate or a pin integral with the slider or with the ring nut, having the function of keeping the arms slightly spaced apart in the unlocked condition of the multi-functional device. This advantageously makes it possible for there to be an easier insertion of the lock of hair to be curled between the arms and the subsequent extraction of the hair from the arms once it has been curled.

Preferably, said heating means comprise a first and a second heating element, that is housed in a respective one of said mobile half-arms; alternatively, said heater is housed in a respective one of said fixed half-arms; more preferably, said at least one heating element is suitable for heating both said mobile half-arms and said fixed half-arms.

The Applicant has indeed observed that, in general, in order to relatively quickly obtain curls that have a certain consistency and that last for some time, it is necessary for the locks of hair to be curled to be wound on surfaces that are entirely heated, so that the entire lock of hair undergoes heating during the time necessary for the setting to obtain the curling.

Preferably, each one of the mobile half-arms comprises a tip that is positioned at the second area remote from the handgrip. Said tips facilitate the guiding of the lock towards the slit between the two mobile half-arms.

Preferably, the tip is made from heat-insulating material. In such a way, the heat emitted by the heating means is not transmitted to the end part of the device, thus improving the manageability of the device itself and avoiding unpleasant burning of the user and/or of the person the hair of whom is being curled.

Preferably, at least one of the arms comprises at least one relief formed on the convex face of the respective fixed half-arm and extending transversally with respect to the longitudinal axis. Preferably, said at least one relief is a helix.

BRIEF DESCRIPTIONS OF THE DRAWINGS

Further characteristics and advantages of the multi-functional device of the present invention shall become clearer from the following detailed description of some of its preferred embodiments, given purely as an example and not for limiting purposes with reference to the attached drawings.

Figure 10:
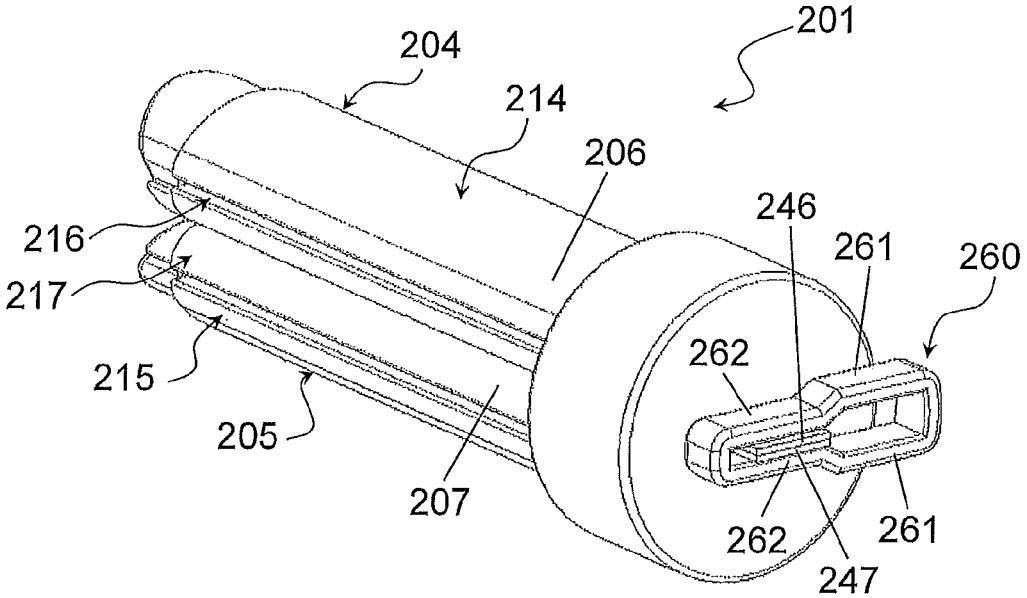
FIG. 10 is a perspective view of part of a multi-functional device according to a second embodiment of the present invention, with the locking/unlocking means engaged.
Figure 11A:
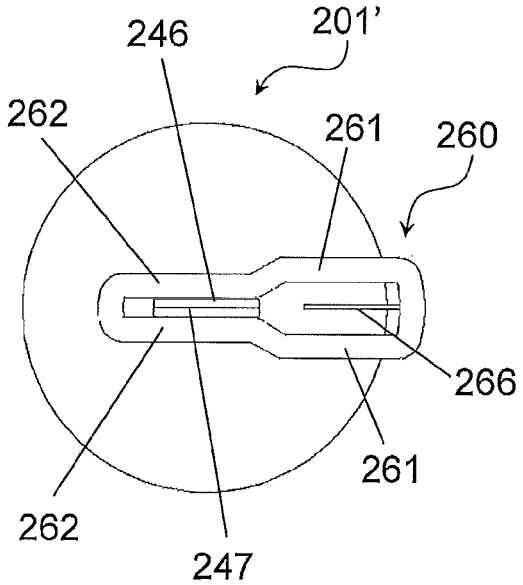
Figure 11B:
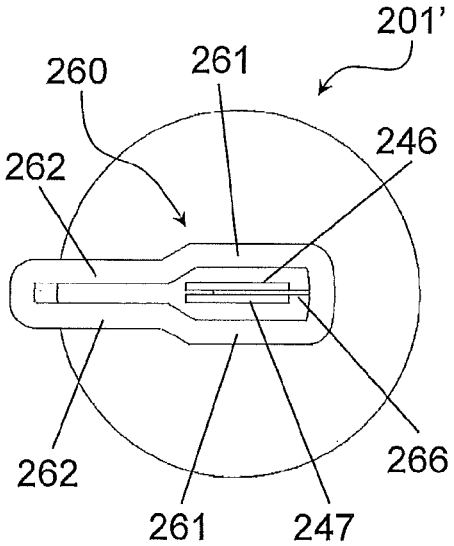

FIGS. 11*a* and 11*b* are front views of a detail of FIG. 10, which show a variant of the locking/unlocking means, respectively in the inserted and disinserted conditions thereof.

Figure 12:
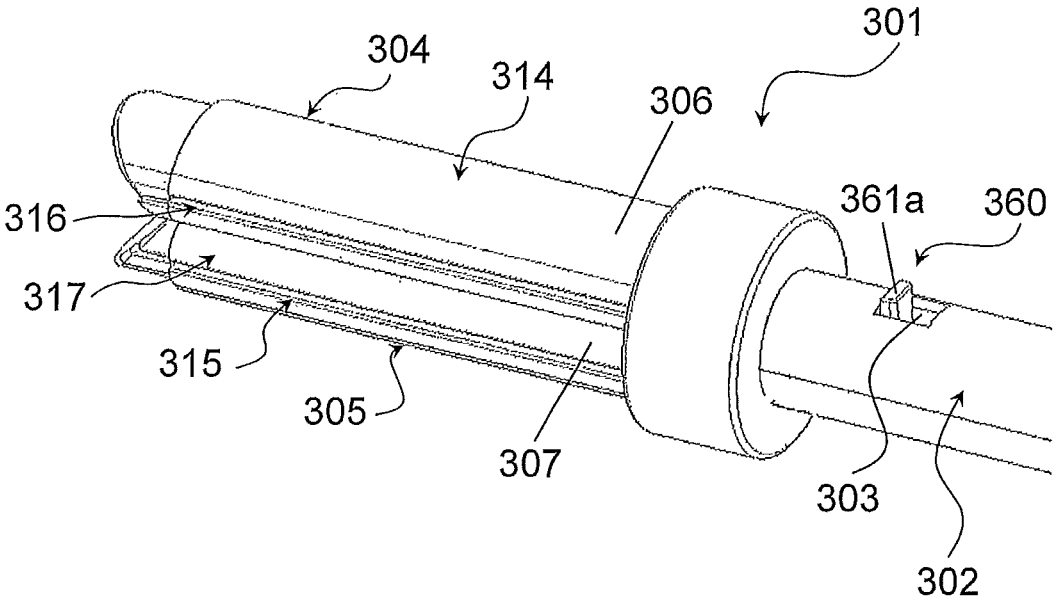

FIG. 12 is a partial perspective view of a multi-functional device according to a third embodiment of the present invention.

Figure 13:
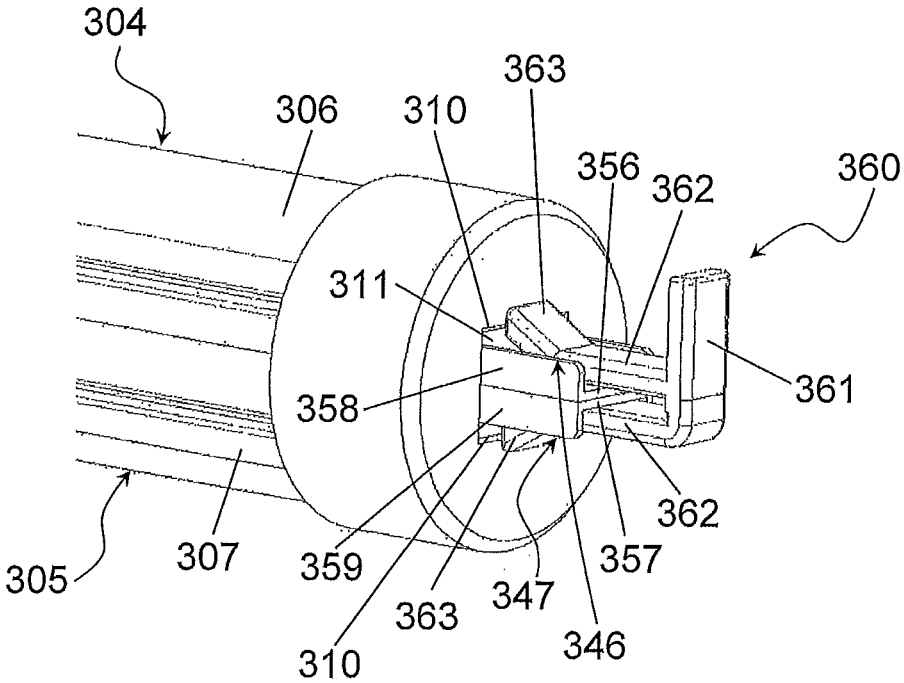

FIG. 13 is a perspective view of part of the device of FIG. 11, with the locking/unlocking means that are inserted.

Figure 14:
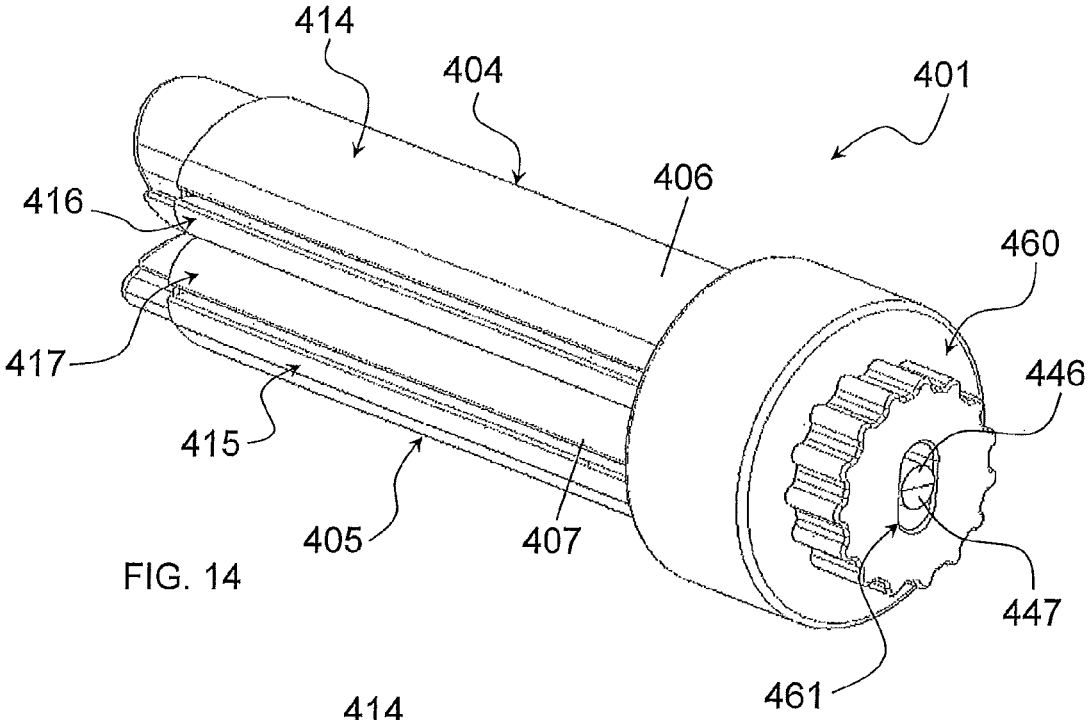

FIG. 14 is a perspective view of part of a multi-functional device according to a fourth embodiment of the invention, with the locking/unlocking means disinserted.

Figure 15:
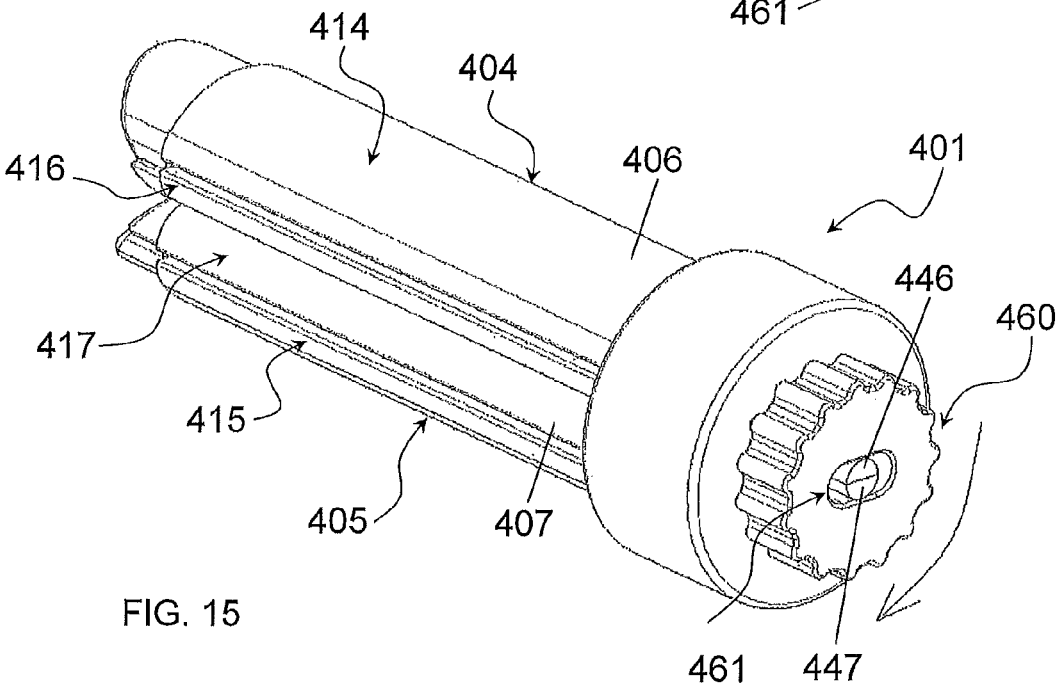

FIG. 15 is a perspective view of the device of FIG. 14, with the locking/unlocking means that are inserted.

Figure 16:
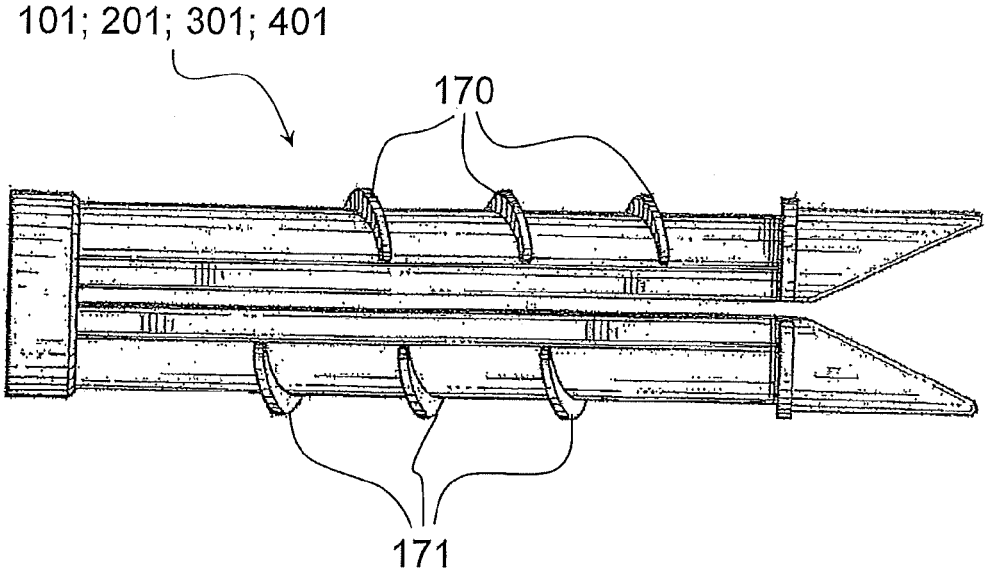

FIG. 16 is a side view of a multi-functional device according to a fifth embodiment of the present invention.

DETAILED DESCRIPTIONS OF THE DISCLOSURE

Figure 1:
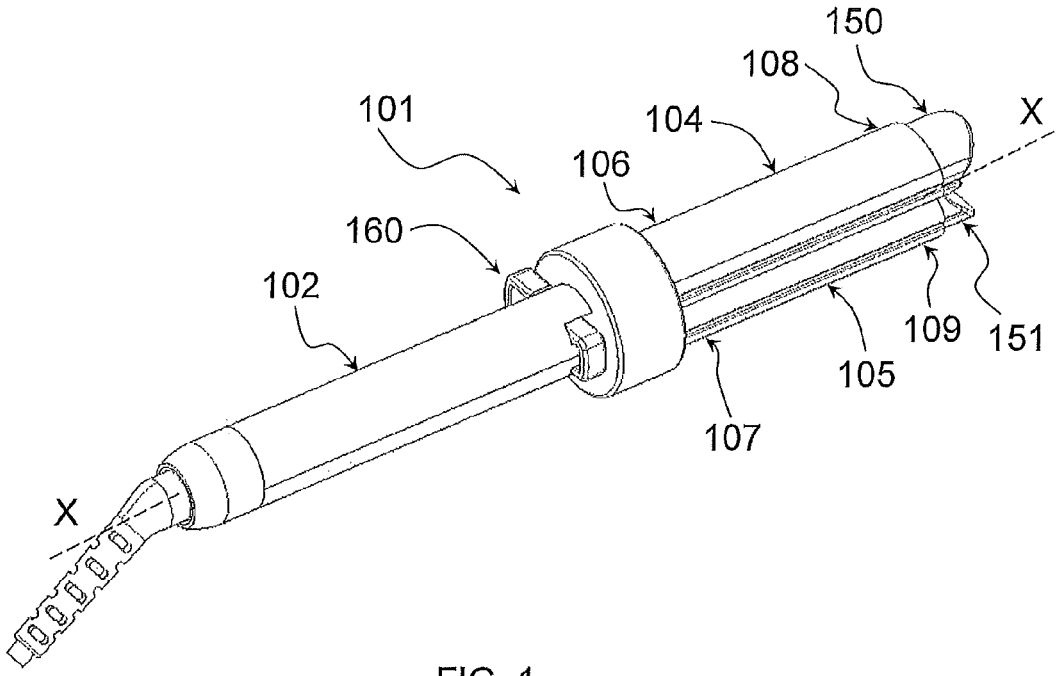
FIG. 1 is a perspective view of a multi-functional device according to a first embodiment of the present invention in a first operation mode as a device for curling hair.
Figure 2:
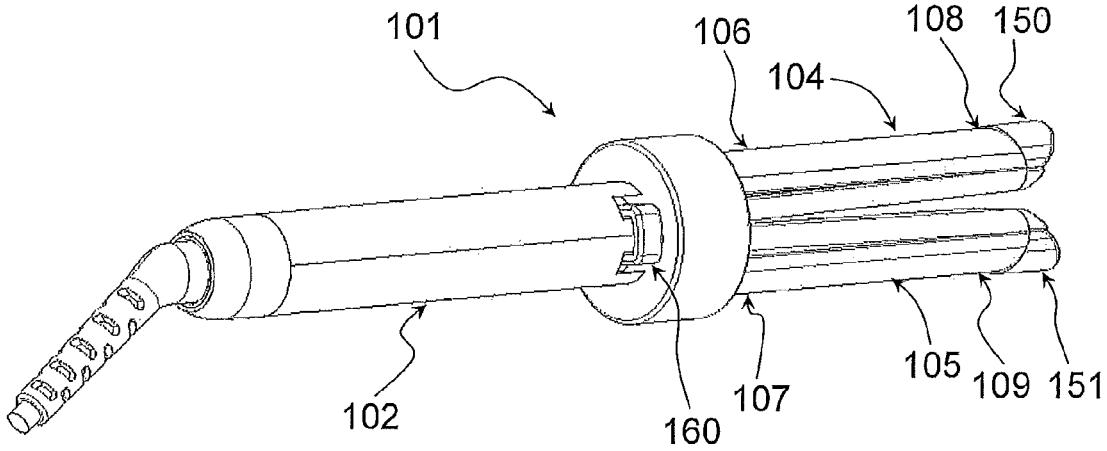
FIG. 2 is a perspective view of the multi-functional device of FIG. 1 in a second operation mode as a device for straightening hair.
Figure 3:
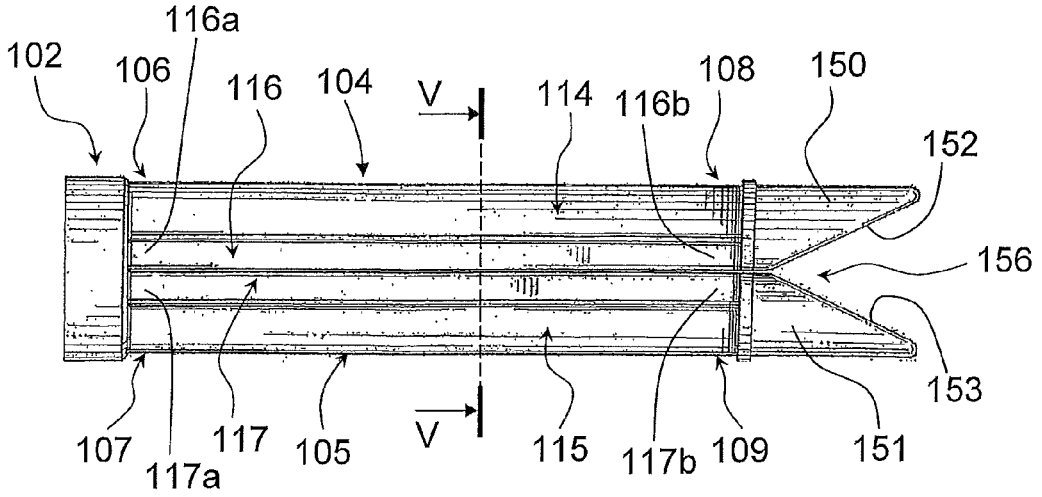
FIG. 3 is a side view of part of the device of FIGS. 1 and 2.

With reference to FIGS. 1 to 3, reference numeral 101 indicates a multi-functional device for styling hair according to a first embodiment of the present invention.

The device 101 comprises a handgrip 102, a first arm 104 and a second arm 105, that are substantially equal to one another and extend along a longitudinal axis X. The two arms 104, 105, are arranged side-by-side and parallel to one another and aligned with the handgrip 102. On one side, at a first end 106 thereof, the first arm 104 is associated with the handgrip 102; analogously, at a first end 107 thereof, the second arm 105 is associated with the handgrip 102. The two arms 104, 105 are associated with the handgrip 102 in an independent manner from one another.

Figure 4:
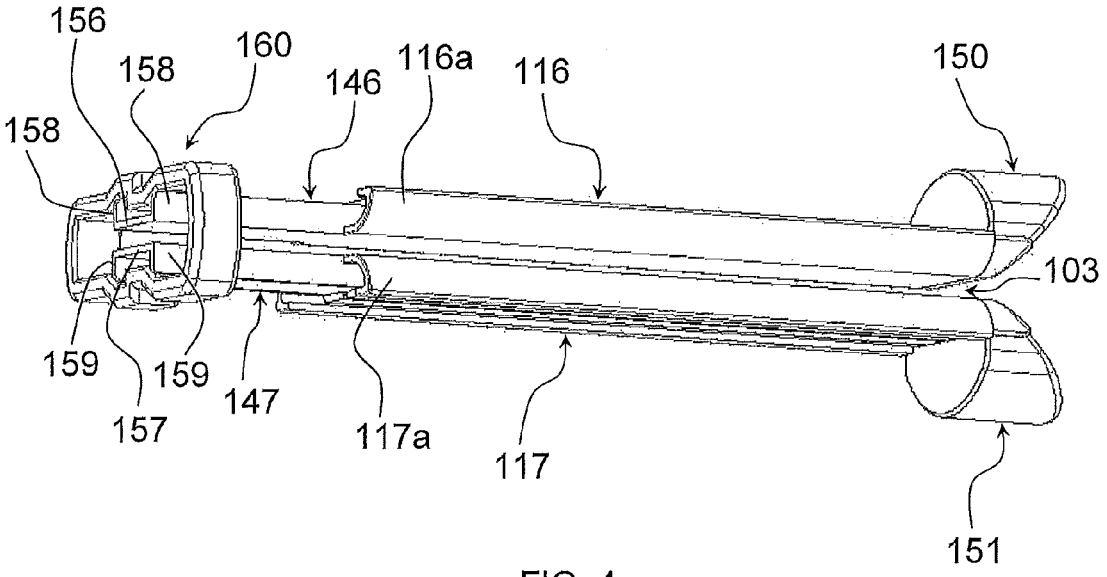
FIG. 4 is a perspective view of part of the device of FIGS. 1 to 3.
Figure 5:
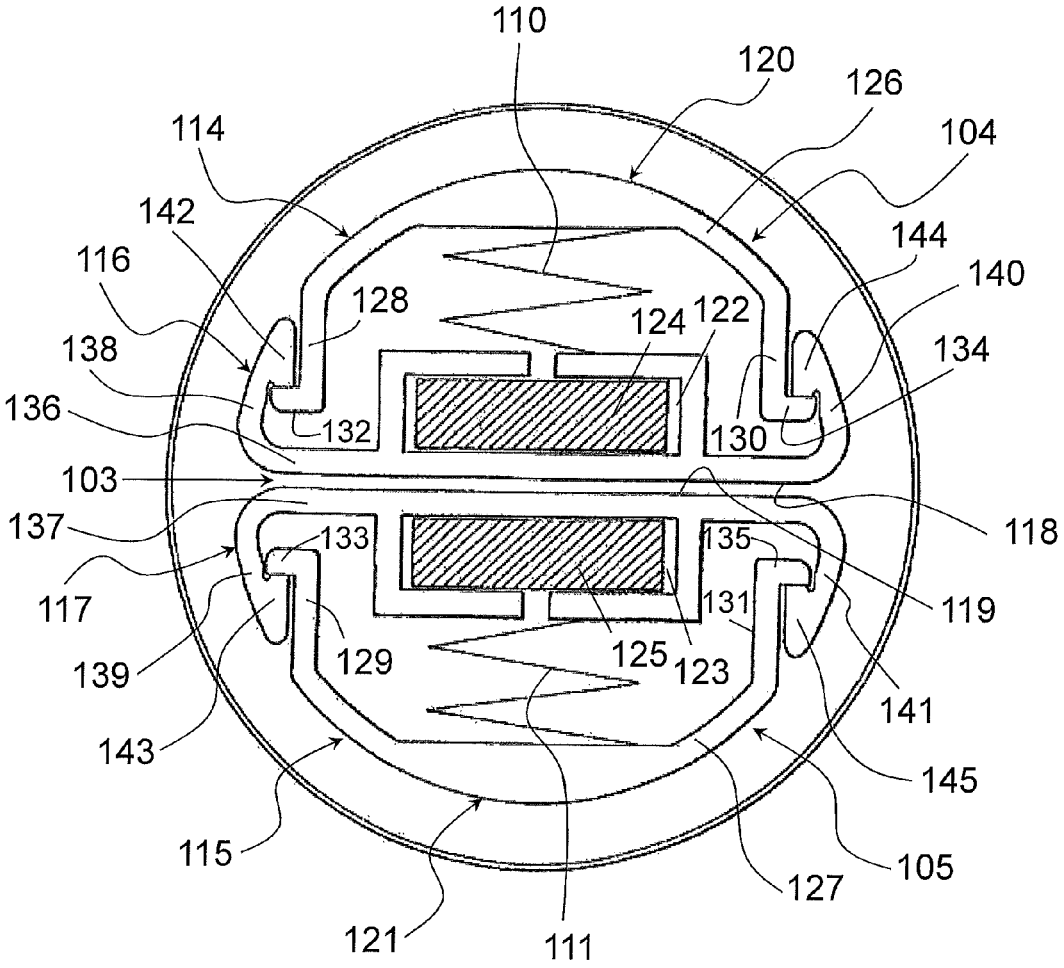
FIG. 5 is a sectional view in an enlarged scale of the device of FIGS. 1 to 4, taken along the line V-V of FIG. 3.

As illustrated in FIGS. 3 to 5, the first arm 104 comprises a first fixed half-arm 114, which is integral with the handgrip 102 and extends substantially along the longitudinal axis X, and a first mobile half-arm 116, that is elastically supported by the first fixed half-arm 114 and extends substantially along the longitudinal axis X between a first area 116*a* of the first arm 104 close to the handgrip 102 and a second area 116*b* of the first arm 104 remote from the handgrip 102. Analogously, the second arm 105 comprises a second fixed half-arm 115, which is integral with the handgrip 102 and extends substantially along the longitudinal axis X, and a second mobile half-arm 117, that is elastically supported by the second fixed half-arm 115 and extends substantially along the longitudinal axis X between a first area 117*a* of the second arm 105 close to the handgrip 102 and a second area 117*b* of the second arm 105 that is remote from the handgrip 102.

The first and the second arm 104, 105 have an overall semi-cylindrical shape, with first flat faces 118, 119 that are formed on the mobile half-arms 116, 117 and second convex faces 120, 121 that are formed on the fixed half-arms 114, 115; the first flat faces 118, 119 face one another, the second convex faces 120, 121 face opposite to one another.

Inside each mobile half-arm 116, 117, respective seats 122, 123, are obtained where heating means are housed, formed by respective heating elements 124, 125. In such a position, the heating element 124, 125 is suitable, in operative conditions, for heating both the first flat face 118, 119 and the second convex face 120, 121 of the arm 104, 105. The heating elements 124 and 125 are preferably electric resistors, of the per se known type, having suitable power, for example electric resistances or PTC (positive temperature coefficient heater) or ceramic resistances (ceramic heater) such as to reach a temperature of between 140° C. and 250° C.

The first flat faces 118, 119 are in front of one another, at a distance that is constant for the entire length thereof, in the resting conditions of the device 101 illustrated in the figures. In the embodiment shown in FIGS. 1-5, such a distance is close to zero, or rather lower than 2 mm; in such a way a very narrow slit 103 is possibly created between the two flat faces. Preferably, the flat faces 118, 119 undergo finishing through known methods, such as coating, electro-cladding, anodizing and the like. This advantageously allows a smooth sliding, or without jamming, of the lock between the arms, as conventionally occurs with known hair straightening devices.

The first fixed half-arm 114 is obtained by a metal section bar and has—seen in section, see in particular FIG. 5—a main portion 126, that extends according to the convex face 120, said main portion 126 being flanked by two opposite guiding tabs 128, 130, which extend in a direction that is substantially perpendicular to the flat face 118. The guiding tabs 128, 130 end with respective projections 132, 134, projecting outwards with respect to the guiding tabs 128, 130.

The first mobile half-arm 116 is also formed by a metal section bar and has—seen in section, see in particular FIG. 5—a main portion 136, that extends according to the flat face 118, said main portion 136 being flanked by two opposite guiding tabs 138, 140, which extend in a direction that is almost perpendicular to the flat face 18, facing towards the main portion 126 of the fixed half-arm 114. The guiding tabs 138, 140 end with respective projections 142, 144, projecting inwards with respect to the guiding tabs 138, 140.

The first mobile half-arm 116 is engaged with the first fixed half-arm 114 by means of the respective guiding tabs 128, 130 and 138, 140; in particular, as clearly visible in FIG. 5, the guiding tabs 138 and 140 surmount the guiding tabs 128 and 130, and the respective projections 132 and 134 of the first fixed half-arm 114 are engaged with the respective projections 142 and 144 of the first mobile half-arm 116, so that the disengagement of the first mobile half-arm 16 from the first fixed half-arm 114 is prevented.

The structure of the second arm 105 is the same as that of the first arm 104 described above. Therefore, the second fixed half-arm 115 is obtained by a metal section bar and has—seen in section, see in particular FIG. 5—a main portion 127, extending according to the convex face 121, said main portion 127 being flanked by two opposite guiding tabs 129, 131, which extend in a direction that is substantially perpendicular to the flat face 119. The guiding tabs 129, 131 end with respective projections 133, 135, projecting outwards with respect to the guiding tabs 129, 131.

Analogously, the second mobile half-arm 117 is also formed by a metal section bar and has—seen in section, see in particular FIG. 5—a main portion 137, which extends according to the flat face 119, said main portion 137 being flanked by two opposite guiding tabs 139, 141, which extend in an almost perpendicular direction with respect to the flat face 119, facing towards the main portion 127 of the fixed half-arm 115. The guiding tabs 139, 141 end with respective projections 143, 145, projecting inwards with respect to the guiding tabs 139, 141.

Correspondingly, the second mobile half-arm 117 is engaged with the second fixed half-arm 115 by means of the respective guiding tabs 129, 131 and 139, 141; in particular, as clearly visible in FIG. 5, the guiding tabs 139 and 141 surmount the guiding tabs 129 and 131, and the respective projections 133 and 135 of the second fixed half-arm 115 are engaged with the respective projections 143 and 145 of the second mobile half-arm 117, so that the disengagement of the second mobile half-arm 117 from the second fixed half-arm 115 is prevented.

Each arm 104, 105 then comprises, between its fixed half-arm 114, 115 and its mobile half-arm 116, 117, elastic means for elastically pushing the half-arms away from one another, so that when resting they take up the position shown in FIGS. 1-5, in particular in FIG. 5. Such elastic means, represented only schematically and indicated with reference numerals 110, 111, can be various types of springs (leaf, helical, pin, etc.), or rather groups of them.

Of course, any configuration of arms suitable for the purpose, or rather arms that are provided with a fixed half-arm and with a mobile half-arm that are elastically supported by the fixed half-arm, fall within the scope of the present invention.

Each arm 104, 105 further comprises a tip 150, 151 that is positioned at a second end 108, 109 of the second arm, on the opposite side with respect to the handgrip 102. The shape of the tip 150, 151 is tapered, so as to have a front wall 152, 153 that is inclined with respect to the axis X; the front walls 152 and 153 of the two tips 150 and 151 face one another, so as to form a space 156 for facilitating the insertion of the locks of hair to be curled or straightened between the two arms 104 and 105. On the opposite side with respect to the inclined front wall 152, 153, the tip 150, 151 has a shape corresponding to the arm 104, 105, so as to join with it.

Each tip 150, 151 is made from heat insulating material, for example in a special known plastic material, preferably of the injection moulding type, such as PPS or the like.

The device 101 is also provided with electrical connections (not shown in the figures) for supplying the heating elements 124, 125. Such connections can also comprise members for adjusting the electric power (also not shown), so as to adjust the heating of the heating elements 124, 125, in a per se known manner.

With particular reference to FIG. 4, the device 101 further comprises locking/unlocking means suitable for cooperating with the first mobile half-arm and/or the second mobile half-arm to make the first mobile half-arm 116 and/or the second mobile half-arm 117 to selectively take up one from an unlocked condition, in which the elastic movement of the first and/or the second mobile half-arm 116, 117 with respect to the corresponding fixed half-arm 114, 115, is allowed and a locked condition, in which the elastic movement of the first and/or the second mobile half-arm 116, 117 with respect to the fixed half-arm, 114, 115 is prevented at least at the respective first area 116*a*, 117*a* of each arm 104, 105. Preferably, the locking/unlocking means are associated with the handgrip 102 of the device 101.

In the embodiment illustrated, the locking/unlocking means comprise a mechanical actuation member, specifically a slider 160 that is associated with the handgrip 102, a first tang 146 that is integral with the first mobile half-arm 116 at the first area 116*a* close to the handgrip 102 and a second tang 147 that is integral with the second mobile half-atm 117 at the first area 117*a* close to the handgrip 102.

Preferably, the slider 160 can be housed in a seat (not shown) that is integral with the device 101. Such a seat, together with the shape of the slider 160, acts as a support and guide thereof, defining its stroke and at the same time, in locking condition of the device 101, preventing movements of the first and/or second mobile half-arm 116, 117 in the direction of the respective fixed half-arm 114, 115, at least at the first area close to the handgrip.

In particular, the first tang 146 of the first mobile half-arm 116 comprises a flat face 156 and two engagement tabs 158 that extend upwards from the flat face 156 in a direction that is substantially perpendicular to it; the second tang 147 of the second mobile half-arm 117 comprises a flat face 157 and two engagement tabs 159 that extend downwards from the flat face 157 in a direction that is substantially perpendicular to it.

With particular reference to FIGS. 6 to 9, the slider 160 can slide transversally with respect to the longitudinal axis X so as to engage the tangs 146, 147 of the mobile half-arms 116, 117 so as to make the mobile half-arms 116, 117 take up one from an unlocked condition (FIGS. 6 and 7), in which the elastic movement of each mobile half-arm 116, 117 with respect to the corresponding fixed half-arm 114, 115 is allowed, and a locked position (FIGS. 8 and 9), in which the elastic movement of each mobile half-arm 116, 117 with respect to the corresponding fixed half-arm 114, 115 is prevented at the first area 116*a*, 117*a* close to the handgrip 102.

Preferably, the slider 160 is made in the form of a section bar of heat insulating material, for example in a suitable known plastic material, preferably of the injection moulding type, such as PPS or similar and seen in section comprises first and second spaced portions 161*a*, 161*b* and first and second close portions 162*a*, 162*b* alternated therebetween, ramp portions 163, 164 for joining the first spaced portions 161*a* with the first close portions 162*a* and the second spaced portions 161*b* with the second close portions 162*b*, respectively, and portions 165, 166 for, connecting the first spaced portions 161*a* with the second close portions 162*b*, respectively.

Figure 6:
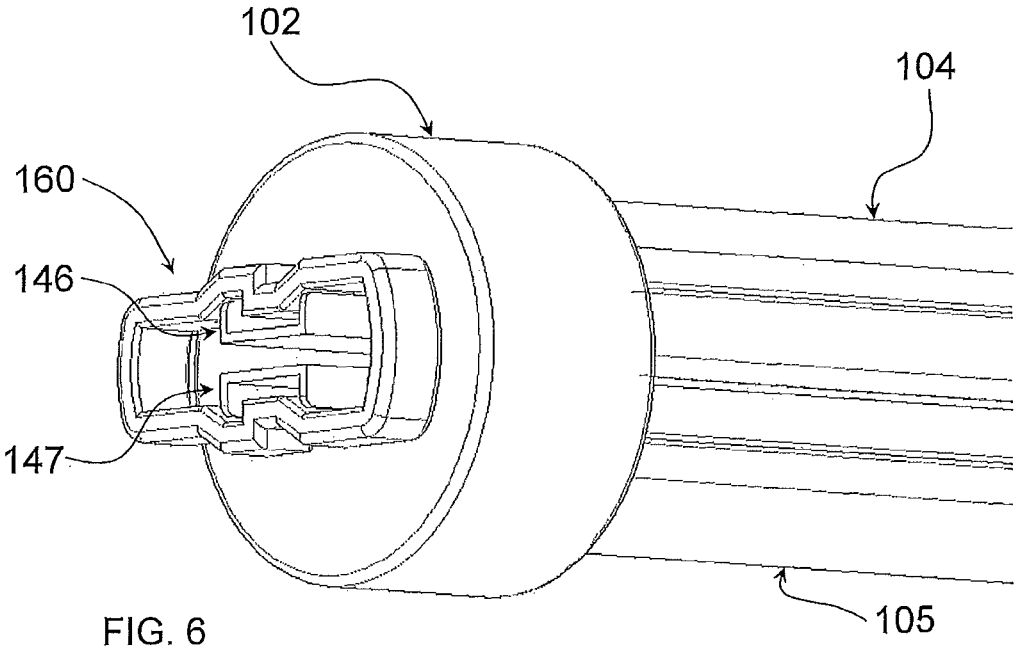
FIG. 6 is a perspective view of part of the device of FIGS. 1 to 5 with the locking/unlocking means disinserted.
Figure 7:
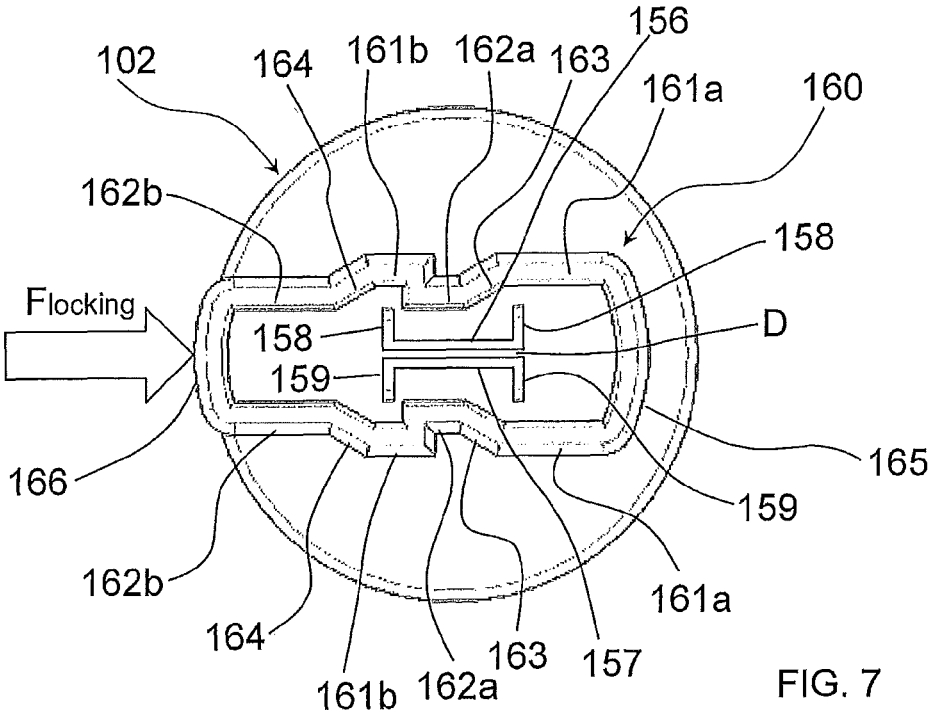
FIG. 7 is a front view of the detail of FIG. 6.

In particular, and as shown in detail in FIGS. 6 and 7, the first and second spaced portions 161*a*, 161*b* leave the engagement tabs 158, 159 of the first and of the second tang 146, 147 of the first and second mobile half-arm 116, 117 of the arms 104, 105 of the device 101 free to travel in the unlocked condition of the elastic movement of each mobile half-arm 116, 117. In such an operative condition, the device 101 operates as a device for curling hair.

Figure 8:
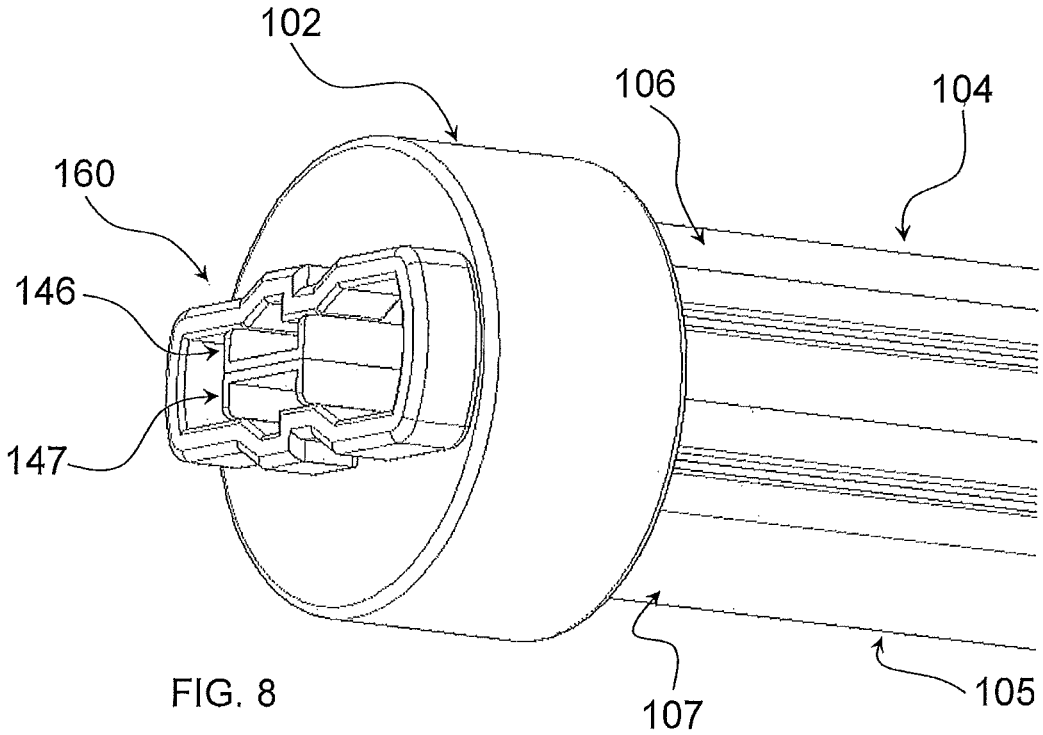
FIG. 8 is a perspective view of part of the device of FIGS. 1 to 5 with the locking/unlocking means inserted.
Figure 9:
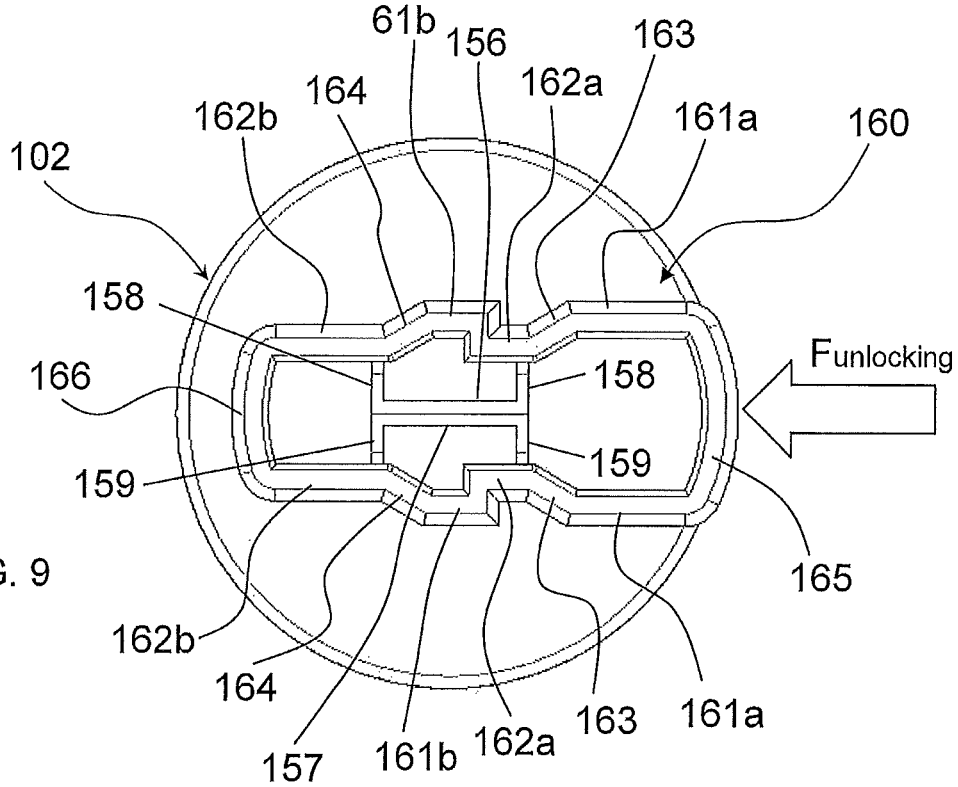
FIG. 9 is a front view of the detail of FIG. 8.

On the other hand, and as shown in detail in FIGS. 8 and 9, the first and the second close portions 162*a*, 162*b* are suitable for engaging the engagement tabs 158, 159 of the first and second tang 146, 147 of the first and second mobile half-arm 116, 117 of the arms 104, 105 of the device 101 in the locking condition of the elastic movement of each mobile half-arm 116, 117. In such an operative condition, the device 101 operates as a device for straightening hair. As a result the distance between the engagement tabs 158, 159 of the tangs 146, 147 is therefore equal to the distance between the close portions 162*a*, 162*b* and it is fixed, or rather, it cannot be spaced apart.

Again with reference to FIGS. 6 to 9, the operation of the device 101 according to the invention will be now described.

Let us suppose that the slider 160 is in the operative unlocking condition of the elastic movement of the mobile half-arms 116, 117 with respect to the fixed half-arms 114, 115 shown in FIGS. 6 and 7. In such an operative condition, the engagement tabs 158, 159 of the tangs 146, 147 of the mobile half-arms 116, 117 face towards the first and second spaced portions 161*a*, 161*b* of the slider 160, with the flat faces 156, 157 being in contact with one another since they are subject to the pressure of the elastic means 110, 111 or in any case spaced apart by a minimum amount D substantially corresponding to the slit 103 between the first flat faces 118, 119 of the mobile half-arms 116, 117 in the resting conditions of the device.

In such an operative unlocking condition, the tangs 146 and 147 are free to move between the spaced portions 161*a*, 161*b* of the slider 160 and the first and second mobile half-arm 116, 117 of the device 101 are, therefore free to move elastically with respect to the first and second fixed half-arm 114, 115 and the device 101 is in the "hair curling" mode.

Let us suppose now that, from this condition, a user desires to straighten her hair. For such a purpose, she must bring the device 101 from the "hair curling" mode to the "hair straightening" mode. This occurs by acting on the slider 160 making it slide with respect to the longitudinal axis X in the direction indicated by the arrow $F_{locking}$ of FIG. 7.

Following such a sliding, as illustrated in FIGS. 8 and 9, the engagement tabs 158, 159 of the first and second tang 146, 147 of the first and second mobile half-arm 116, 117 are brought in abutment against the first and second close portions 162*a*, 162*b* of the slider 160, with the flat faces 156, 157 of the tangs 146, 147 being in contact. In such an operative condition, the first and the second mobile half-arm 116, 117 are thus locked, in contact at the respective first areas 116*a*, 117*a*. The first and the second mobile half-arm 116, 117 are on the other hand free to move away from one another, compressing the springs 110, 111 at the respective second areas 116*b*, 117*b*.

The user can at this point introduce a lock of hair to be straightened between the arms 104, 105 and act on the tips 150, 151 so as to bring the arms 104, 105 together and exert the desired pressure for the straightening.

The presence of the lock prevents the action on the tips 150, 151 from determining a lever effect that would make the first areas 116*a* and 117*a* of the mobile half-arms move away from one another, determining a condition that is counter-productive in order to obtain a good result. The presence of the lock ensures on the other hand that the action on the tips 150, 151 determines a pressure directly onto the lock, which can be varied by the user with her fingers, said pressure being indispensable for a straightening operation.

At this stage the user can make the device 101 slide for the entire length of the lock, so as to completely straighten it. By acting with her own hands on the tips 150, 151, the user can furthermore suitably calibrate the compression force between the arms 104, 105 and therefore the degree of straightening of the lock. When the device 101 is made to slide along the lock of hair to straighten it, the arms 104, 105 are heated by the heating elements 124, 125. In particular, the heating elements 124, 125 can be active in a permanent manner and not only during the sliding of the device along the lock.

Let us suppose now that starting from this last condition, in which the device 101 is in "straight hair" mode, the user desires to curl her hair. For such a purpose she must bring the device 101 from the "straight hair" modality to the "curled hair" modality. This occurs by again acting on the slider 160 making it slide with respect to the longitudinal axis X in the direction opposite to the locking direction, indicated by the arrow $F_{unlocking}$ of FIG. 9.

Following such a translation, as illustrated in FIGS. 6 and 7, the engagement tabs 158, 159 of the tangs 146, 147 of the mobile half-arms 116, 117 are brought facing one another towards the first and the second spaced portions 161*a*, 161*b* of the slider 160, with the flat faces 156, 157 of the tangs 146, 147 that are substantially in contact or in any case spaced apart by the amount D. In such an operative condition, the movement of the mobile half-arms 116, 117 is allowed (also in their first area 116*a* and 117*a*), in contrast with the action of the elastic means 110, 111 and, as shown more clearly in FIG. 4, the arms 104, 105 are spaced apart for their entire length by the slit 103.

The user at this stage can introduce the lock of hair to be curled between the arms 104, 105 making it pass through the space 156 between the tips 150 and 151 and therefore guiding it to be inserted in the slit 103 between the flat faces 118, 119 of the arms 104, 105. As a result, the mobile half-arms 116, 117 tend to separate from one another, thus compressing the elastic means 110, 111 and increasing the width of the slit 103. The lock of hair thus remains held between the two arms 104 and 105 and is delicately held by the elastic thrust of the elastic means 110, 111 on the mobile half-arms 116 and 117.

The user thus winds the lock of hair around the two arms 104, 105 with a rotation movement of the device 101 about the axis X. Alternatively, according to an embodiment that is not shown, the group of two arms 104 and 105 can be made to rotate with respect to the handgrip by a manual mechanical rotation of the heated cylinder or by the action of an electric motor that is activated by the user by means of a suitable command.

When the lock of hair is wound, the arms 104, 105 are heated for a period of time necessary for the hair to become curled. During such a time, the heating elements 124, 125 are supplied with power, so as to heat the arms 104 and 105; depending on the construction choices of the device 101, the electric power supply and thus the heating can be activated only when the lock of hair has been wound, or even before, in particular in a permanent manner.

Subsequently, the device 101 is made to slide away from the head of the person whose hair is being curled, possibly accompanying the lock with the other hand. This operation of creating the curl would not be possible, or it would be possible with considerable difficulties, if the slider 160 were switched in modality "straight hair", since the winding of the lock about the heated cylinder requires a greater flexibility of the mobile half-arms 116, 117 along their entire extension, with the great risk of jamming or very poor sliding of the lock itself during the operative step.

A multi-functional device according to the invention can be made according to many other embodiments. FIGS. 10 to 16 show some embodiments, with some features in common with the device 101 of the first embodiment according to FIGS. 1 to 9 and other different features. These shall be described in the rest of the description, with particular reference to the features that are different with respect to the device 101. It should be understood that other embodiments can be made, which combine the features of one or more of the embodiments shown or that, more in general, make it possible to carry out the same function.

FIG. 10 shows a multi-functional device 201 according to a second embodiment of the invention. The device 201 is completely similar to the device 101, from which it differs by the fact that it has a different configuration of the locking/unlocking means. In particular, the device 201 comprises a handgrip (not shown in FIG. 10) and a first arm 214 and a second arm 215 that are associated with the handgrip at a respective first end 206, 207. The first arm 204 and the second arm 205 comprise a respective fixed half-arm 214, 215 that is integral with the handgrip and a respective mobile half-arm 216, 217 that is elastically supported by the corresponding fixed half-arm 214, 215.

The device 201 further comprises locking/unlocking means that are preferably associated with the handgrip having the same function as the locking/unlocking means of the device 101. In particular, the locking/unlocking means comprise a slider 260, a first plate-like tang 246 that is integral with the mobile half-arm 216 of the first arm 214 and a second plate-like tang 247 that is integral with the mobile half-arm 217 of the second arm 215. The slider 260 has the form of a section bar, preferably in a heat-insulating plastic material and comprises spaced portions 261 and close portions 262, that are suitable for engaging and disengaging the first and the second plate-like tang 246, 247.

Preferably, the slider 260 can be housed in a seat (not shown) that is integral with the device 201. Such a seat, together with the form of the slider 260, acts as a support and guide thereof, defining the stroke and at the same time, in the locking condition of the device 201, preventing movements of the first and/or second mobile half-arm 216, 217 in the direction of the respective fixed half-arm 214, 215, at least at the first area close to the handgrip.

In use, the slider 260 can slide in the direction that is transversal with respect to the longitudinal axis X of the arms 214, 215 between a locked position, shown in FIG. 10, in which the tangs 246, 247 are in tight engagement between the close portions 262 of the tang 260, and an unlocked position (not shown), in which the tangs 246, 247 are in engagement substantially mobile between the spaced portions 261 of the tang 260. Analogously to what has been described above with reference to the device 101, in the locked position, the device 201 acts as a device for straightening hair, whereas in the unlocked position the device 201 acts as a device for curling hair.

FIGS. 11*a* and 11*b* illustrate a detail of an embodiment of the multi-functional device of FIG. 10, designated in general with the reference numeral 201'. The device 201' differs from the device 201 of FIG. 10 by the fact that the locking/unlocking means comprise a spacer element 266. Such a spacer element 266 preferably has the shape of a plate or a pin that is integral with the slider 260 and suitable for being inserted/disinserted between/from the tangs 246 and 247 so as to keep the arms of the device 201' slightly spaced apart in the unlocked condition of the device 201'.

In the locking condition of the device 201', illustrated in FIG. 11*a*, the spacer element 266 is suitably spaced apart, and therefore disengaged, from the tangs 246 and 247, whereas in the unlocked condition of the device 201', the spacer element 266 is inserted between the tangs 246 and 247, so as to keep the arms of the device slightly spaced apart therebetween. This advantageously allows obtaining an easier insertion between the arms of the lock to be curled and its subsequent extraction from the arms once it has been curled.

FIGS. 12 and 13 illustrate a multi-functional device 301 according to a third embodiment of the invention. The device 301 comprises a handgrip 302 and a first arm 314 and a second arm 315 associated with the handgrip 302 at a respective first end 306, 307 thereof. The first arm 304 and the second arm 305 comprise a respective first fixed half-arm 314, 315 that is integral with the handgrip 302 and a respective first mobile half-arm 316, 317 that is elastically supported by the corresponding first fixed half-arm 314, 315.

The device 301 also has locking/unlocking means comprising a slider 360 that is preferably associated with the handgrip, a first tang 346 that is integral with the first mobile half-arm 316 and a second tang 347 that is integral with the second mobile half-arm 317. The tangs 346 and 347 have a structure that is similar to the tangs of the device 101, or rather each comprises a flat face 356, 357 and two tabs 358, 359 (optional) extending perpendicularly from the respective flat face 356, 357. In use the tangs 346, 347 are arranged with the flat faces 356, 357 facing one another, with the tabs 358, 359 (optional) facing upwards and downwards, respectively.

Preferably, the slider 360 can be housed in a seat (not shown) integral with the device 301. Such a seat, together with the shape of the slider 360, acts as a support and guide thereof, defining the stroke and preventing at the same time, in locking condition of the device 101, movements of the first and/or second mobile half-arm 316, 317 in the direction of the respective fixed half-arm 314, 315, at least at the first area close to the handgrip.

The slider 360 comprises an actuation portion 361, preferably in rigid plastic material, a pair of parallel arms 362 for engaging the tangs 346, 347, preferably made from flexible plastic material, extending perpendicular and suitably spaced apart from the actuation element 361, and end portions 363, also preferably in flexible plastic material, each one extending from a respective arm 362 of the pair of arms 362 moving away from one another.

In the assembled position of the device 301, one free end 361*a* of the actuation portion 360 projects from an opening 303 that is formed in the handgrip 302, whereas the tangs 346, 347, in particular their flat faces 356, 357 are arranged between the engagement arms 362.

In use, the slider 360 can be made to slide from the user parallel with respect to the longitudinal axis X of the arms 314, 315 (see FIG. 12) between a locked position and an unlocked position of each mobile half-arm 316, 317 with respect to the corresponding fixed half-arm 314, 315.

In particular, in the locked position, shown in FIG. 13, the flat faces 356, 357 of the tangs 346, 347 are clamped between the engagement arms 362 of the slider 360. In such an operative condition, the elastic movement of the mobile half-arms 316, 317 with respect to the fixed half-arms 314, 315 is prevented at the area of the arms close to the handgrip. The device 301 thus acts as a device for straightening hair.

In order to bring the slider 360 into the unlocked position, this is made to slide along the longitudinal axis X, towards the handgrip 302, thus freeing up the tangs 346, 347 from the grip of the engagement arms 362 of the slider 360. In such an operative condition, the elastic movement of the mobile half-arms 316, 317 is allowed with respect to the fixed half-arms 314, 315 and the device 301 thus acts as a device for curling hair.

FIGS. 14 and 15 illustrate a multi-functional device 401 according to a fourth embodiment of the present invention. The device 401 comprises a handgrip (not shown) and a first arm 404 and a second arm 405 that are associated with the handgrip at a respective first end 406, 407. The first arm 404 and the second arm 405 comprise a respective first fixed half-arm 414, 415 that is integral with the handgrip and a respective first mobile half-arm 416, 417 that is elastically supported by the corresponding first fixed half-arm 414, 415.

The device 401 differs from the other devices that have been previously described in that the locking/unlocking means comprise a mechanical member, specifically a ring nut 460. Such a ring nut 460 is preferably associated with the handgrip and is provided with an opening 461, preferably slot-shaped, for engaging with a pair of tangs 446, 447, each integral with a respective mobile half-arm 416, 417 of the first and the second arm 404, 405. In particular, the ring nut 460 can be rotated by the user around the longitudinal axis X of the arms 401, 405 between an unlocked position, shown in FIG. 13, in which the slot-shaped opening 461 is arranged vertically with the tangs 446, 447 that are mobile inside it, and a locked position, shown in FIG. 14, in which the slot-shaped opening 461 is arranged horizontally with the tangs 446, 447 locked inside it.

The function of the slot-shaped opening can be alternatively carried out also by a central protuberance of the ring nut that is provided with the same slot-shaped opening.

Finally, FIG. 16, shows an alternative embodiment of a device 101 in accordance with the first embodiment of the present invention, in which the arms 104, 105 have, above the respective convex faces 120, 121, a series of reliefs 170, 171 that make it possible to guide the position of the lock of hair during its winding about the arms 104, 105. Preferably, such reliefs have a helical shape.

In particular, the reliefs 170 on the convex face 120 of the first arm 104 are offset with respect to the reliefs 171 on the convex face 121 of the second arm 105, or rather they are not aligned with them.

This allows the lock of hair to be wound in an even better manner so as to undergo curling. Indeed, since the reliefs of one arm are offset with respect to that of the other arm, it is possible to give the lock, in the step of winding around the arms, a diagonal direction with respect to the length of the arms, so as to direct the lock from one arm to the other, each time a round is carried out, towards the space between two successive reliefs, thus optimising the overall heating of the lock itself, in addition to offering a greater help to the user engaged in winding the lock.

In such a way it is possible to minimise the possibility of the lock becoming loose from the curling iron device too easily before the curling step has been completed and the possibility of the lock winding around itself. In particular, the reliefs 170 and 171 can be arranged in a way such as to create a helix.

Of course modifications, variants, replacements and integrations to the embodiments previously described can be made without for this reason departing from the scope of protection of the invention as defined by the following claims. For example, although the embodiments illustrated in the figures foresee tangs on both the mobile half-arms of the multi-functional device, it should be understood that the field of protection of the present invention also covers embodiments in which the tang is foreseen on only one of the mobile half-arms or embodiments without tangs and the slider of which is directly engaged with the surfaces of the mobile half-arms. Again, although the spacer element has been described and illustrated only with reference to a particular embodiment of the multi-functional device, a spacer element that is completely analogous can be associated with the locking/unlocking means of all possible embodiments of the device illustrated and within the capabilities of a man skilled in the art.

The invention claimed is:

1. A multi-functional device for styling hair comprising a handgrip, a first and a second arm, and heating means for heating at least one of said first and second arm, wherein:

said first and second arm are arranged side-by-side and parallel to one another and extending substantially along a longitudinal axis, associated with said handgrip at a first end thereof, respectively;

said first arm comprises a first fixed half-arm integral with the handgrip and extending substantially along the longitudinal axis and a first mobile half-arm elastically supported by said first fixed half-arm and extending substantially along the longitudinal axis between a first area of said first arm close to the handgrip and a second area of said first arm remote from the handgrip;

said second arm comprises a second fixed half-arm integral with the handgrip and extending substantially along the longitudinal axis and a second mobile half-arm elastically supported by said second fixed half-arm and extending substantially along the longitudinal axis between a first area of said second arm close to the handgrip and a second area of said second arm remote from the handgrip;

wherein the device also comprises locking/unlocking means for cooperating with said first mobile half-arm to make the first mobile half-arm to selectively take up one from an unlocked condition, in which the elastic movement of the first mobile half-arm with respect to the first fixed half-arm is allowed, and a locked condition, in which the elastic movement of the first mobile half-arm with respect to the first fixed half-arm is prevented at least at said first area of the first arm; and wherein said locking/unlocking means for cooperating with said second mobile half-arm to make said second mobile half-arm selectively take up one from an unlocked condition, in which the elastic movement of the second mobile half-arm with respect to the second fixed half-arm is allowed, and a locked condition, in which the elastic movement of the second mobile half-arm with respect to the second fixed half-arm is prevented at least at said first area of the second arm.

2. The device according to claim 1, wherein said locking/unlocking means comprise a mechanical member suitable for being actuated through sliding, rotation or pressure to make at least one of the first mobile half-arm and the second mobile half-arm selectively take up one from said unlocked and locked conditions.

3. The device according to claim 2, wherein said mechanical member is associated with the handgrip.

4. The device according to claim 2, wherein said mechanical member is a slider and in that said locking/unlocking means also comprise a first tang integral with at least one of the first mobile half-arm at the first area of the first arm and a second tang integral with the second mobile half-arm at the first area of the second arm, said slider being slidable so as to engage and disengage at least one of said first tang and said second tang.

5. The device according to claim 4, wherein said slider comprises spaced portions and close portions suitable for engaging and disengaging at least one of said first tang and said second tang, said slider being able to slide in a transversal direction to the longitudinal axis.

6. The device according to claim 5, wherein that in the locking condition of the elastic movement of at least one of the first and the second mobile half-arm with respect to at least one of the first and the second fixed half-arm, at least one of said first tang and said second tang abut against said close portions of the slider at least at the first area of at least one of the first and second arm.

7. The device according to claim 4, wherein said slider comprises an actuation portion and a pair of close and parallel arms suitable for engaging and disengaging at least one of said first tang and said second tang, said slider being able to slide in a direction parallel to the longitudinal axis.

8. The device according to claim 7, wherein in the locking condition of the elastic movement of at least one of the first and second mobile half-arm with respect to at least one of the first and second fixed half-arm, at least one of said first tang and said second tang are clamped into contact between said pair of close and parallel arms at least at the first area of at least one of the first and second arm.

9. The device according to claim 2, wherein said mechanical member is a ring nut and in that said locking/unlocking means also comprise a first tang integral with the first mobile half-arm at the first area of at least one of the first arm and a second tang integral with the second mobile half-arm at the first area of the second arm, said ring nut being rotatable about the longitudinal axis so as to engage and disengage at least one of said first tang and said second tang.

10. The device according to claim 9, wherein said ring nut comprises an opening or a shaped protuberance, in which at least one of said first tang and said second tang engage and disengage.

11. The device according to claim 10, wherein said opening or said shaped protuberance is slot-shaped, at least one of said first tang and said second tang are semi-circular shaped and, in the locking condition of the elastic movement of at least one of the first and second mobile half-arm with respect to at least one of the first and second fixed half-arm, at least one of said first tang and said second tang abut against the narrower walls of the slot shape at least at the first area of at least one of the first and second arm.

12. The device according to claim 1, wherein said locking/unlocking means also comprise a spacer element suitable for being inserted/disinserted between the first and second mobile half-arms-to keep them slightly spaced apart in the unlocked condition.

* * * * *